US011165130B2

(12) United States Patent
Noguchi

(10) Patent No.: US 11,165,130 B2
(45) Date of Patent: Nov. 2, 2021

(54) THREE-WAY DIVIDER

(71) Applicant: PANASONIC INTELLECTUAL PROPERTY MANAGEMENT CO., LTD., Osaka (JP)

(72) Inventor: Wataru Noguchi, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/969,013

(22) PCT Filed: Jan. 22, 2020

(86) PCT No.: PCT/JP2020/002037
§ 371 (c)(1),
(2) Date: Aug. 11, 2020

(87) PCT Pub. No.: WO2020/240917
PCT Pub. Date: Dec. 3, 2020

(65) Prior Publication Data

US 2021/0218121 A1 Jul. 15, 2021

(30) Foreign Application Priority Data

May 29, 2019 (JP) ..... JP2019-100276

(51) Int. Cl.
*H01P 5/19* (2006.01)
*H01P 3/08* (2006.01)

(52) U.S. Cl.
CPC ..... *H01P 5/19* (2013.01); *H01P 3/081* (2013.01)

(58) Field of Classification Search
CPC ..... H01P 5/19; H01P 3/081
(Continued)

(56) References Cited

U.S. PATENT DOCUMENTS 8,937,517 B2 * 1/2015 Huang ..... H01P 5/16 333/128
2010/0039187 A1 2/2010 Yurugi et al.

FOREIGN PATENT DOCUMENTS

JP 2015-035759 A 2/2015
WO 2008/038576 A1 4/2008

OTHER PUBLICATIONS

Yongle Wu, et al., "An Analytical Approach for a Novel Coupled-Line Dual-Band Wilkinson Power Divider," IEEE Transactions on Microwave Theory and Techniques, vol. 59, No. 2, 2011, pp. 286-294.

(Continued)

*Primary Examiner* — Robert J Pascal
*Assistant Examiner* — Kimberly E Glenn
(74) *Attorney, Agent, or Firm* — McDermott Will & Emery LLP

(57) ABSTRACT

Three-way divider includes first transmission line, second transmission line, and third transmission line. First transmission line includes first input-side line and first output-side line, which are connected at first connection point. Second transmission line includes second input-side line and second output-side line, which are connected at second connection point. Third transmission line includes third input-side line and third output-side line, which are connected at third connection point. Each of first transmission line, second transmission line, and third transmission line has an electrical length that is ¼ a wavelength of a second frequency. The first connection point and the second connection point, the third connection point and the second connection point, the first output terminal and the second output terminal, and the third output terminal and the second output terminal are respectively connected via corresponding resistors.

5 Claims, 11 Drawing Sheets

(58) Field of Classification Search
USPC ..... 333/100
See application file for complete search history.

(56) References Cited

OTHER PUBLICATIONS

Japanese Office Action dated Mar. 30, 2021 issued in corresponding Japanese Patent Application No. 2020-536304.
International Search Report and Written Opinion dated Feb. 18, 2020 in International Application No. PCT/JP2020/002037.

* cited by examiner

THREE-WAY DIVIDER

CROSS-REFERENCE OF RELATED APPLICATIONS

This application is the U.S. National Phase under 35 U.S.C. § 371 of International Patent Application No. PCT/JP2020/002037, filed on Jan. 22, 2020, which in turn claims the benefit of Japanese Application No. 2019-100276, filed on May 29, 2019, the entire disclosures of which Applications are incorporated by reference herein.

TECHNICAL FIELD

The present disclosure relates to a three-way divider.

BACKGROUND ART

In recent years, wireless terminals based on standards such as wireless LAN (Local Area Network) and Bluetooth (registered trademark) are being installed in household appliances such as televisions and audio devices, for example, beyond just information devices such as personal computers. As such, household appliances sometimes communicate wirelessly in a plurality of frequency bands, each corresponding to one of a plurality of standards. Additionally, techniques are known in which an array antenna is used as an antenna used for wireless communication in order to achieve a desired directionality. When such an array antenna is used, it is necessary to divide signals in a plurality of frequency bands for a plurality of antennas. PTL 1, for example, discloses a Wilkinson-type three-way divider capable of three-way division of signals in two frequency bands.

CITATION LIST

Patent Literature

PTL 1: Japanese Unexamined Patent Application Publication No. 2015-35759

SUMMARY OF THE INVENTION

Technical Problem

There is demand for miniaturization in wireless terminals, and as such, there is demand for miniaturization in dividers provided in wireless terminals.

Accordingly, the present disclosure provides a small three-way divider capable of three-way distribution of signals in two frequency bands.

Solution to Problem

A three-way divider according to one aspect of the present disclosure is a three-way divider that divides a signal three ways. The three-way divider includes: an input terminal into which the signal is input; a first output terminal, a second output terminal, and a third output terminal, each of which outputs a corresponding one of three divided signals obtained by the signal having been divided three ways; a first transmission line, a second transmission line, and a third transmission line that connect the input terminal to the first output terminal, the second output terminal, and the third output terminal, respectively; and a first resistor, a second resistor, a third resistor, and a fourth resistor. The first transmission line includes, in order from a side on which the input terminal is located, a first input-side line and a first output-side line connected in series at a first connection point. The second transmission line includes, in order from the side on which the input terminal is located, a second input-side line and a second output-side line connected in series at a second connection point. The third transmission line includes, in order from the side on which the input terminal is located, a third input-side line and a third output-side line connected in series at a third connection point. Each of the first input-side line, the second input-side line, and the third input-side line has an electrical length that is ¼ a wavelength of a first frequency. Each of the first transmission line, the second transmission line, and the third transmission line has an electrical length that is ¼ a wavelength of a second frequency that is lower than the first frequency. The first connection point and the second connection point are connected via the first resistor, the third connection point and the second connection point are connected via the second resistor, the first output terminal and the second output terminal are connected via the third resistor, and the third output terminal and the second output terminal are connected via the fourth resistor.

Advantageous Effect of Invention

According to the present disclosure, a small three-way divider capable of three-way division of signals in two frequency bands can be provided.

DESCRIPTION OF EXEMPLARY EMBODIMENTS

Figure 1:
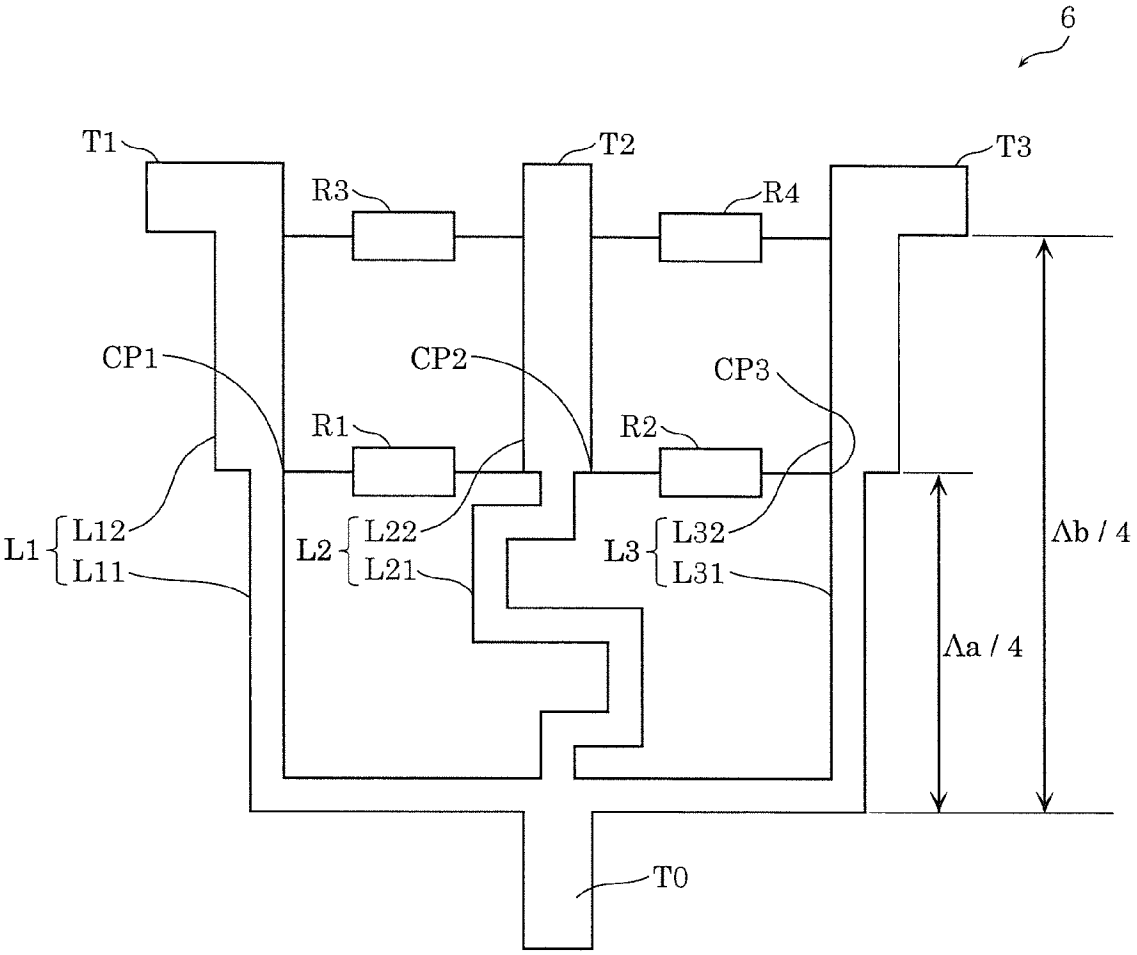
FIG. 1 is a schematic diagram illustrating the configuration of a three-way divider according to Embodiment 1.

Embodiments of the present disclosure will be described hereinafter with reference to the drawings.

Note that the following embodiments describe comprehensive or specific examples of the present disclosure. The numerical values, shapes, materials, constituent elements, arrangements and connection states of constituent elements, steps, orders of steps, and the like in the following embodiments are merely examples, and are not intended to limit the present disclosure.

Additionally, the drawings are schematic diagrams, and are not necessarily exact illustrations. In the drawings, constituent elements which are the same are given the same reference signs.

Embodiment 1

A three-way divider according to Embodiment 1 will be described.

1-1. Configuration

First, the configuration of a three-way divider according to the present embodiment will be described with reference to FIG. 1. FIG. 1 is a schematic diagram illustrating the configuration of three-way divider 6 according to the present embodiment.

Three-way divider 6 according to the present embodiment is a divider which divides signals in a first frequency band and a second frequency band three ways.

As illustrated in FIG. 1, three-way divider 6 includes input terminal T0, first output terminal T1, second output terminal T2, third output terminal T3, first transmission line L1, second transmission line L2, third transmission line L3, first resistor R1, second resistor R2, third resistor R3, and fourth resistor R4.

Input terminal T0 is a terminal into which a signal is input. In the present embodiment, a signal in a first frequency band including a first frequency, and a signal in a second frequency band including a second frequency which is lower than the first frequency, are input to input terminal T0. The first frequency band and the second frequency band are not particularly limited. In the present embodiment, the first frequency band and the second frequency band are 5 GHz and 2.4 GHz bands, respectively.

First output terminal T1, second output terminal T2, and third output terminal T3 are terminals which output three divided signals obtained by a signal input from input terminal T0 being divided three ways. In the present embodiment, the three divided signals, which have the same phase, are output from first output terminal T1, second output terminal T2, and third output terminal T3, respectively.

First transmission line L1, second transmission line L2, and third transmission line L3 are lines which connect input terminal T0 to first output terminal T1, second output terminal T2, and third output terminal T3, respectively.

First transmission line L1 includes, from the input terminal T0 side, first input-side line L11 and first output-side line L12, which are connected in series by first connection point CP1. Second transmission line L2 includes, from the input terminal T0 side, second input-side line L21 and second output-side line L22, which are connected in series by second connection point CP2. Third transmission line L3 includes, from the input terminal T0 side, third input-side line L31 and third output-side line L32, which are connected in series by third connection point CP3.

The electrical length of each of first input-side line L11, second input-side line L21, and third input-side line L31 is ¼ the wavelength of the first frequency (Λa/4). The electrical length of each of first transmission line L1, second transmission line L2, and third transmission line L3 is ¼ the wavelength of the second frequency, which is lower than the first frequency (Λb/4).

First resistor R1 is connected between first connection point CP1 and second connection point CP2; second resistor R2, between third connection point CP3 and second connection point CP2; third resistor R3, between first output terminal T1 and second output terminal T2; and fourth resistor R4, between third output terminal T3 and second output terminal T2. First resistor R1, second resistor R2, third resistor R3, and fourth resistor R4 are absorption resistors. For example, when an impedance on an output side of three-way divider 6 is 50Ω, resistance values of third resistor R3 and fourth resistor R4 are twice the outside-side impedance, namely 100Ω, and resistance values of first resistor R1 and second resistor R2 are greater than or equal to twice and less than or equal to four times the output-side impedance, namely greater than or equal to 100Ω and less than or equal to 200Ω. In the present embodiment, the resistance values of first resistor R1, second resistor R2, third resistor R3, and fourth resistor R4 are the same, each being 100Ω.

Each transmission line can be formed, for example, from a conductive member or the like patterned on a main surface of an insulated substrate. Each transmission line is formed, for example, from a metal film such as copper film.

By having the configuration described thus far, three-way divider 6 according to the present embodiment can divide signals in a first frequency band and a second frequency band three ways.

1-2. Actions and Effects

Figure 2:
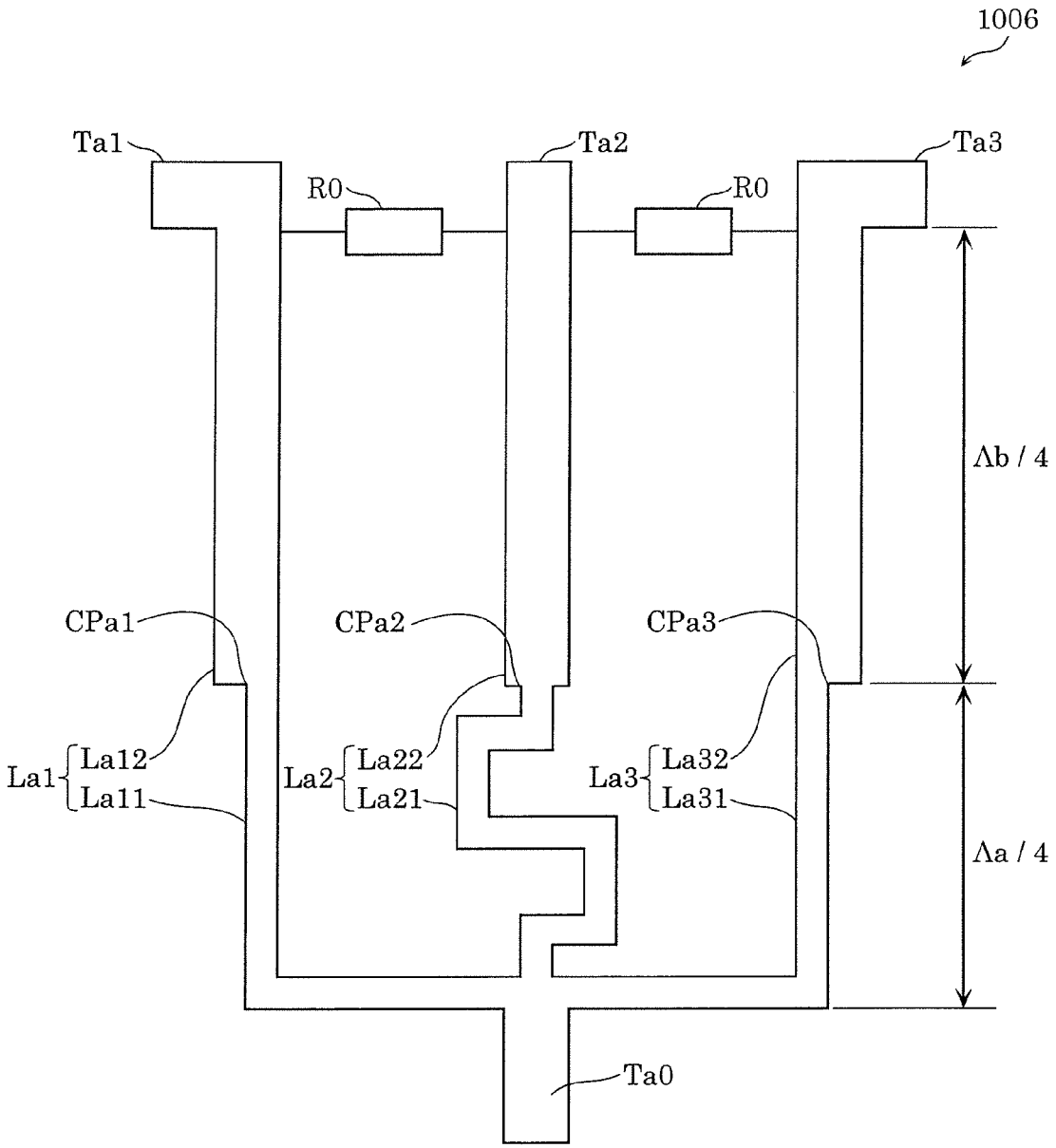
FIG. 2 is a schematic diagram illustrating the configuration of a three-way divider according to a comparative example.

Actions and effects of three-way divider 6 according to the present embodiment will be described next with reference to FIG. 2, in comparison with a three-way divider according to a comparative example. FIG. 2 is a schematic diagram illustrating the configuration of three-way divider 1006 according to the comparative example. Three-way divider 1006 according to the comparative example is a Wilkinson-type three-way divider. As illustrated in FIG. 2, like three-way divider 6 according to the present embodiment, three-way divider 1006 includes input terminal Ta0, first output terminal Ta1, second output terminal Ta2, third output terminal Ta3, first transmission line La1, second transmission line La2, and third transmission line La3.

First transmission line La1 includes, from the input terminal Ta0 side, first input-side line La11 and first output-side line La12, which are connected in series by first connection point CPa1. Second transmission line La1 includes, from the input terminal Ta0 side, second input-side line La21 and second output-side line La22, which are connected in series by second connection point CPa2. Third transmission line La3 includes, from the input terminal Ta0 side, third input-side line La31 and third output-side line La32, which are connected in series by third connection point CPa3. Here, the electrical length of each of first input-side line La11, second input-side line La21, and third input-side line La31 is ¼ the wavelength of the first frequency (Λa/4).

However, in three-way divider 1006 according to the comparative example, the electrical length of each of first output-side line La12, second output-side line La22, and third output-side line La32 is ¼ the wavelength of the second frequency (Λb/4), which is different from the transmission lines in three-way divider 6 according to the present embodiment.

Additionally, three-way divider 1006 according to the comparative example includes two absorption resistors R0, which are respectively connected between first output terminal Ta1 and second output terminal Ta2 and between third output terminal Ta3 and second output terminal Ta2. Absorption resistors are connected neither between first connection point CPa1 and second connection point CPa2, nor between third connection point CPa3 and second connection point CPa2.

In this manner, in the Wilkinson-type three-way divider 1006, it is necessary to set the electrical length of each of first output-side line La12, second output-side line La22, and third output-side line La32, which respectively correspond to first output-side line L12, second output-side line L22, and third output-side line L32 of three-way divider 6 according to the present embodiment, to a wavelength ¼ the second frequency. However, with three-way divider 6 according to the present embodiment, the electrical length of each of first transmission line L1, second transmission line L2, and third transmission line L3 can be set to ¼ the wavelength of the second frequency by connecting absorption resistors between first connection point CP1 and second connection point CP2 and between third connection point CP3 and second connection point CP2. Accordingly, with three-way divider 6 according to the present embodiment, the electrical lengths of first transmission line L1, second transmission line L2, and third transmission line L3 can be made smaller than those in the Wilkinson-type three-way divider 1006 by ¼ the wavelength of the first frequency.

As described thus far, with three-way divider 6 according to the present embodiment, a three-way divider which can divide signals in two frequency bands three ways and which is smaller than past three-way dividers can be realized.

Embodiment 2

An antenna module according to Embodiment 2 will be described. The antenna module according to the present embodiment is an application example of three-way divider 6 according to Embodiment 1.

2-1. Configuration

Figure 3:
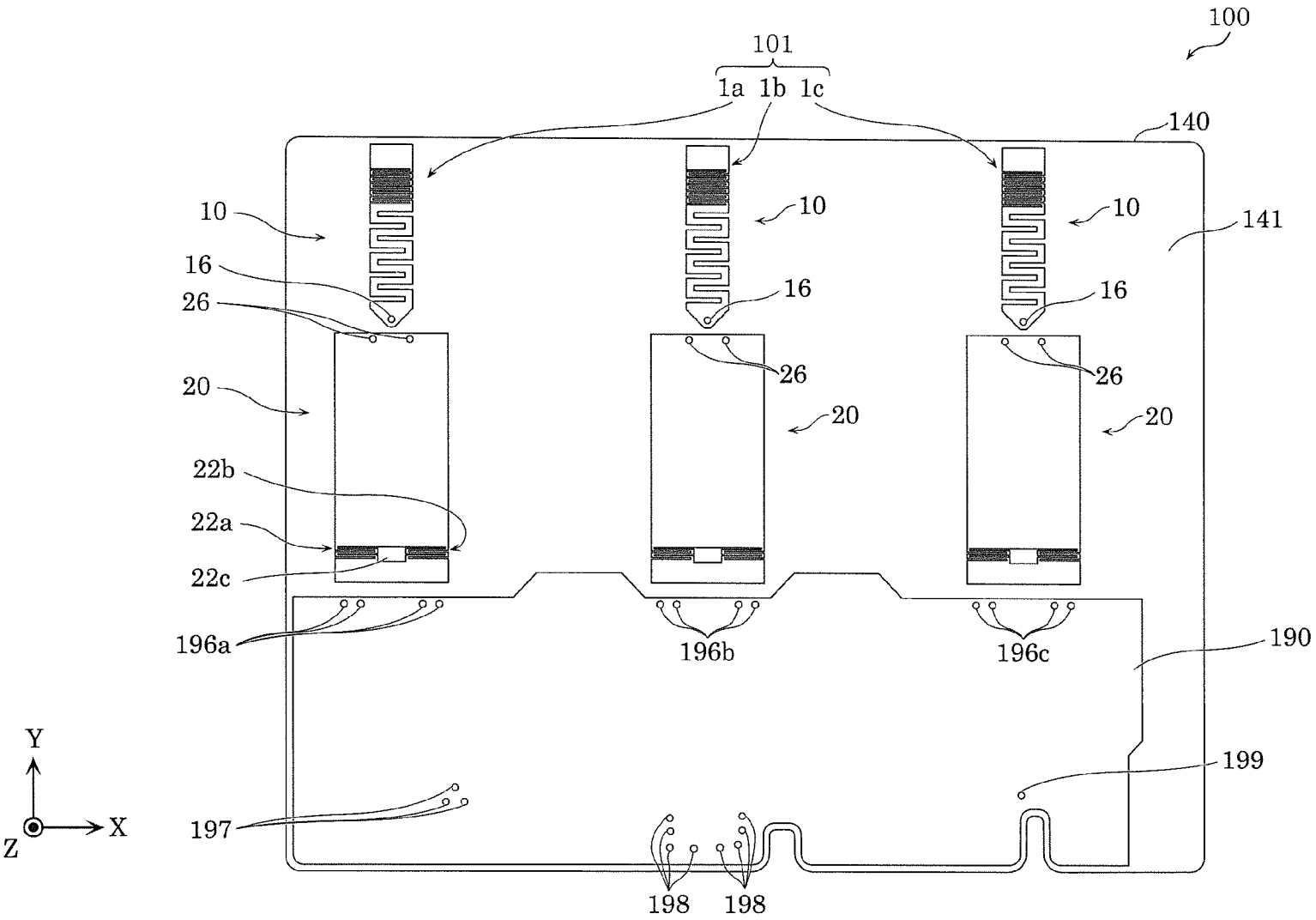
FIG. 3 is a first plan view illustrating the configuration of an antenna module according to Embodiment 2.
Figure 4:
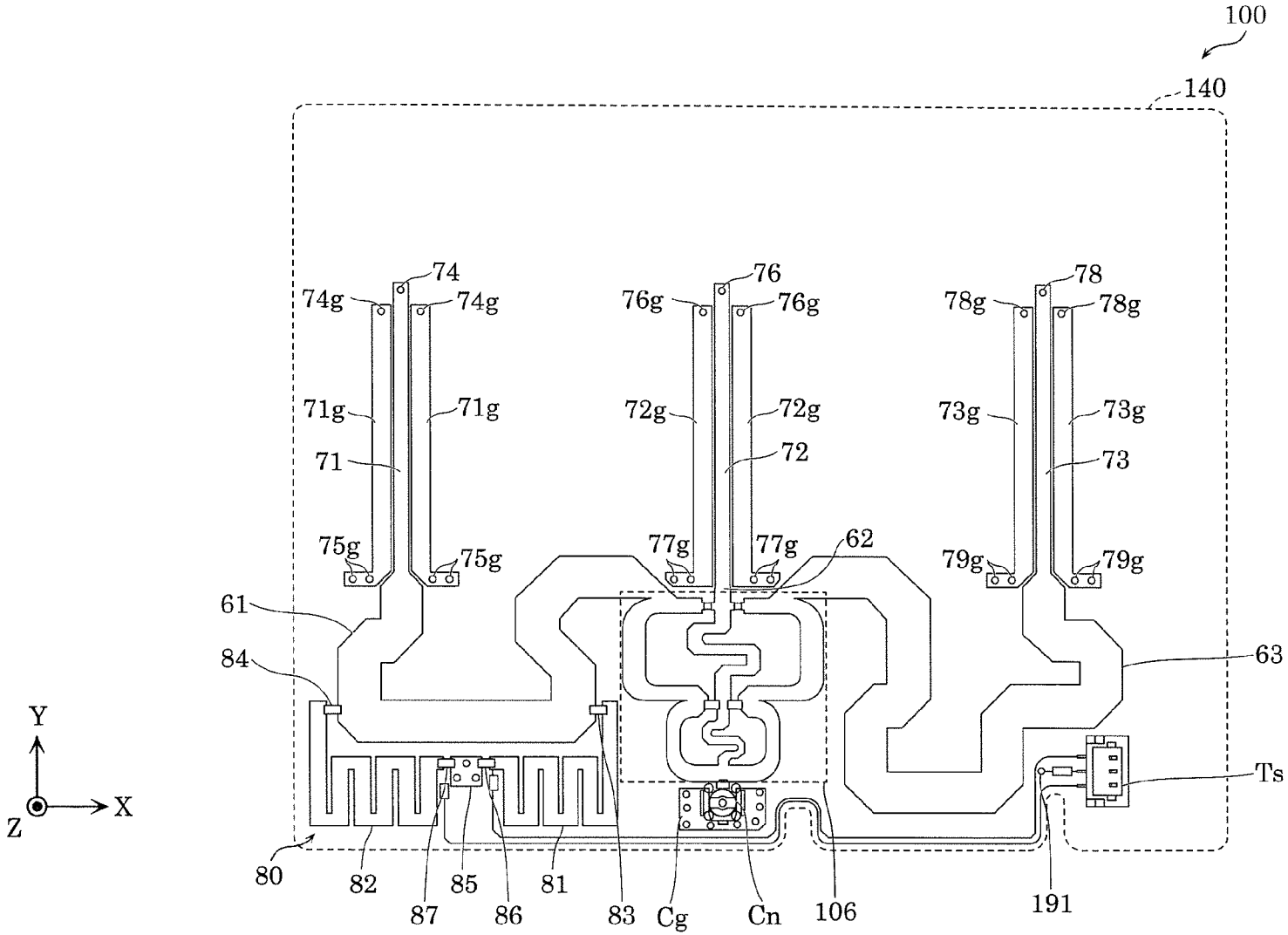
FIG. 4 is a second plan view illustrating the configuration of the antenna module according to Embodiment 2.

First, the configuration of the antenna module according to the present embodiment will be described with reference to FIGS. 3 and 4. FIGS. 3 and 4 are first and second plan views illustrating the configuration of antenna module 100 according to the present embodiment. FIG. 3 is a plan view illustrating one main surface 141 of board 140 of antenna module 100 in plan view. FIG. 4 is a plan view of constituent elements disposed on a main surface of board 140 on the opposite side from main surface 141, which also indicates edges of board 140 with dotted lines. Note that in FIGS. 3 and 4, a direction perpendicular to main surface 141 of board 140 of antenna module 100 is assumed to be a Z-axis direction, and two directions which are both perpendicular to the Z-axis direction and to each other are assumed to be an X-axis direction and a Y-axis direction, respectively.

Antenna module 100 according to the present embodiment is a module including array antenna 101 and a divider which divides a signal for each of multiband antennas constituting array antenna 101. In the present embodiment, antenna module 100 is a module which communicates wirelessly on the basis of the wireless LAN standard, and transmits and receives signals in the 5 GHz and 2.4 GHz bands, which are the first frequency band and the second frequency band, respectively. Antenna module 100 includes three-way divider 106 as a divider. Antenna module 100 further includes ground electrode 190, lines 61, 62, 63, 71, 72, and 73, phase shifter 80, grounding interconnects 71*g*, 72*g*, and 73*g*, connector Cn, and control terminal Ts.

2-1-1. Antenna Array

Array antenna 101 is an antenna including a plurality of multiband antennas. In the present embodiment, array antenna 101 includes three multiband antennas 1*a*, 1*b*, and 1*c*. The three multiband antennas 1*a*, 1*b*, and 1*c* share board 140. The three multiband antennas 1*a*, 1*b*, and 1*c* are arranged in the X-axis direction perpendicular to the Y-axis direction of each of currents.

Figure 5:
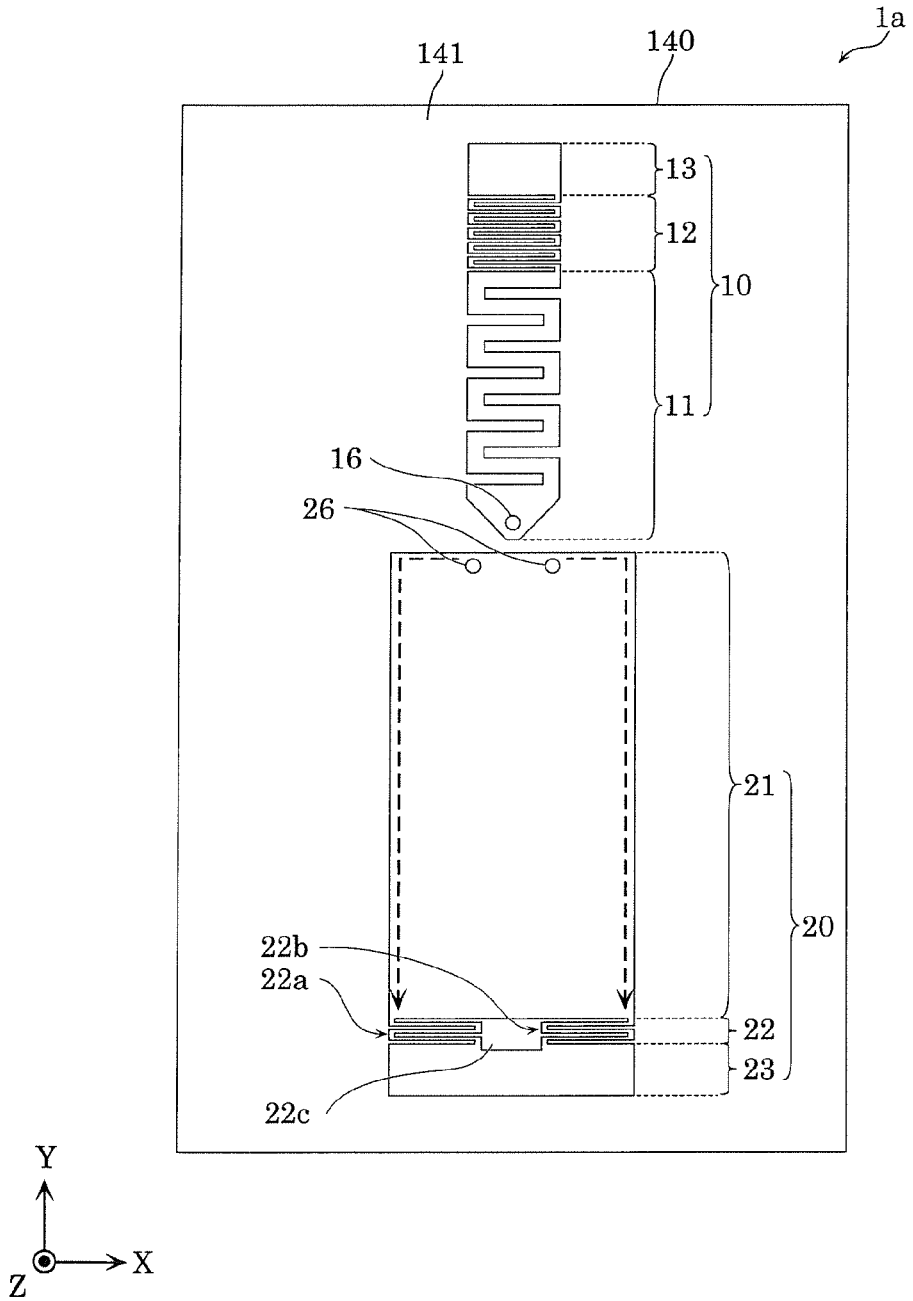
FIG. 5 is a plan view illustrating the configuration of a multiband antenna according to Embodiment 2.

The three multiband antennas 1*a*, 1*b*, and 1*c* have the same configuration. The configuration of multiband antenna 1*a* will be described next with reference to FIG. 5 as a representative example of the three multiband antennas 1*a*, 1*b*, and 1*c*. FIG. 5 is a plan view illustrating the configuration of multiband antenna 1*a* according to the present embodiment.

Multiband antenna 1*a* is an antenna which transmits and receives signals in two frequency bands. In the present embodiment, multiband antenna 1*a* transmits and receives a signal in a first frequency band including a first frequency, and a signal in a second frequency band including a second frequency which is lower than the first frequency. Although the first frequency band and the second frequency band are not particularly limited, in the present embodiment, 5 GHz and 2.4 GHz are used for the first frequency band and the second frequency band, respectively. As such, multiband antenna 1*a* can be used as a dual-band antenna for 5 GHz and 2.4 GHz bands, based on the wireless LAN standard. As illustrated in FIG. 5, multiband antenna 1*a* includes board 140, input terminal 16, antenna part 10, and grounding part 20. In the present embodiment, multiband antenna 1*a* further includes grounding terminals 26.

Board 140 is a member serving as a base of multiband antenna 1*a*. Note that multiband antennas 1*a*, 1*b*, and 1*c* share board 140. Other constituent elements of antenna module 100 are also disposed on board 140. Board 140 is a circuit board, and antenna part 10 and grounding part 20 are disposed on one main surface 141 of board 140. In the present embodiment, board 140 is a rectangular plate-shaped dielectric body. Board 140 is a glass epoxy board, for example.

Input terminal 16 is a terminal which is disposed on board 140 into which a signal is input. In the present embodiment, a high-frequency signal transmitted by multiband antenna 1*a* is input to input terminal 16. Input terminal 16 also functions as an output terminal which outputs a high-frequency signal received by multiband antenna 1*a*. In the present embodiment, a signal is input to input terminal 16 through a via interconnect passing through board 140 from the main surface on the side of board 140 opposite from main surface 141. Input terminal 16 is connected to antenna part 10.

Grounding terminals 26 are terminals which are disposed on board 140 and are grounded. In the present embodiment, grounding terminals 26 are disposed on main surface 141 of board 140 and are connected to grounding part 20. In the present embodiment, grounding terminals 26 are grounded through a via interconnect passing through board 140. Although the number of grounding terminals 26 is not particularly limited, the number is two in the present embodiment.

Antenna part 10 is a conductive member which is disposed on board 140 and connected to input terminal 16. In the present embodiment, a signal in the first frequency band and a signal in the second frequency band resonate in antenna part 10. Radio waves are radiated from antenna part 10 as a result. Antenna part 10 includes, in order from the input terminal 16 side, first low-inductance part 11, first high-inductance part 12, and first tip part 13, which are connected in series. The sum of the electrical lengths of first low-inductance part 11, first high-inductance part 12, and first tip part 13 is ¼ the wavelength of the second frequency. As a result, a signal in the second frequency band including the second frequency resonates in antenna part 10.

The position where antenna part 10 is connected to input terminal 16 is not particularly limited, but in the present embodiment, input terminal 16 is connected to a grounding part 20-side end of first low-inductance part 11. To be more specific, input terminal 16 is disposed only on the grounding part 20-side end of first low-inductance part 11, and is not provided for first high-inductance part 12 and first tip part 13. Note that the end of first low-inductance part 11 means, for example, a region corresponding to a range of no greater than 10% of a length in the Y-axis direction of first low-inductance part 11 from the grounding part 20-side end of first low-inductance part 11.

In the present embodiment, antenna part 10 is a conductive member patterned on main surface 141 of board 140, and is formed, for example, from a metal film such as copper film. Additionally, first low-inductance part 11, first high-inductance part 12, and first tip part 13 are arranged in the Y-axis direction in FIG. 5. Accordingly, the Y-axis direction in FIG. 5 corresponds to a lengthwise direction of antenna part 10 and a resonation direction of signals in antenna part 10. As illustrated in FIG. 5, the widths of first low-inductance part 11, first high-inductance part 12, and first tip part 13 (i.e., the dimensions in the direction perpendicular to the resonation direction and in a direction parallel to main surface 141 of board 140) are the same.

First low-inductance part 11 is a part of antenna part 10 which is connected to input terminal 16. One end of first low-inductance part 11 is connected to input terminal 16, and another end is connected to first high-inductance part 12. The electrical length of first low-inductance part 11 is ¼ the wavelength of the first frequency. First low-inductance part 11 has a lower inductance than first high-inductance part 12. In the present embodiment, first low-inductance part 11 has a meandering shape, as illustrated in FIG. 5, but has an inductance low enough so that first low-inductance part 11 does not act as a choke coil with respect to signals in the first frequency band and the second frequency band (e.g., does not inhibit the signals). Providing first low-inductance part 11 with a meandering shape in this manner makes it possible to reduce the dimension of first low-inductance part 11 in the resonation direction (i.e., the Y-axis direction in FIG. 5).

First high-inductance part 12 is a part of antenna part 10 which is disposed between first low-inductance part 11 and first tip part 13, and has a meandering shape. First high-inductance part 12 has a higher inductance than first low-inductance part 11. In the present embodiment, the meandering shape of first high-inductance part 12 has a smaller line width and smaller intervals than the meandering shape of first low-inductance part 11. This makes the inductance of first high-inductance part 12 higher than first low-inductance part 11. In the present embodiment, first high-inductance part 12 has a meandering shape in which the line width is 0.1 mm, the intervals are 0.1 mm, the length (the dimension in the Y-axis direction in FIG. 5) is 2.1 mm, and the width (the dimension in the X-axis direction in FIG. 5) is 3 mm. First high-inductance part 12 acts as a choke coil with respect to signals in the first frequency band. In other words, the effective electrical length of antenna part 10 with respect to signals in the first frequency band input from input terminal 16 connected to first low-inductance part 11 is the electrical length of first low-inductance part 11 (¼ the wavelength of the first frequency). As a result, a signal in the first frequency band resonates in antenna part 10. Note that first high-inductance part 12 has an inductance low enough so that first high-inductance part 12 does not act as a choke coil with respect to signals in the second frequency band. Accordingly, first high-inductance part 12 does not inhibit signals in the second frequency band. As such, signals in the second frequency band resonate in a channel constituted by first low-inductance part 11, first high-inductance part 12, and first tip part 13 of antenna part 10.

First tip part 13 is a part of antenna part 10 located at an end furthest from input terminal 16 in the resonation direction. Although the shape of first tip part 13 is not particularly limited, first tip part 13 is rectangular in the present embodiment. This makes it possible to increase the current density of first tip part 13 more than if first tip part 13 has a meandering shape, and the radiation efficiency of radio waves from first tip part 13 can be increased as a result.

Grounding part 20 is a conductive member which is disposed on board 140 and insulated from input terminal 16. Grounding part 20 is disposed at a predetermined distance from antenna part 10 in the resonation direction. An interval between antenna part 10 and grounding part 20 is, for example, greater than 0 and less than or equal to approximately 1 mm. The interval between antenna part 10 and grounding part 20 is 0.5 mm in the present embodiment. Additionally, the width of grounding part 20 (e.g., the dimension in a direction perpendicular to the resonation direction and in a direction parallel to main surface 141 of board 140) is greater than the width of antenna part 10.

Grounding part 20 includes second low-inductance part 21, second high-inductance part 22, and second tip part 23, which are connected in series in order from the input terminal 16 side. In the present embodiment, grounding part 20 is a conductive member patterned on main surface 141 of board 140, and is formed, for example, from a metal film such as copper film. Additionally, second low-inductance part 21, second high-inductance part 22, and second tip part 23 are arranged in the Y-axis direction in FIG. 5.

The total electrical length of second low-inductance part 21, second high-inductance part 22, and second tip part 23 is set so that the directionality of radio waves in the second frequency, radiated from antenna part 10, broadens along a plane parallel to the lengthwise direction of antenna part 10 (i.e., the Y-axis direction in FIG. 5) (in other words, a plane parallel to a ZX plane in FIG. 5). A relationship between that total electrical length and the directionality of radio waves in the second frequency can be found through simulations or the like, for example.

Grounding part 20 is connected to grounding terminals 26. The positions where grounding terminals 26 are disposed are not particularly limited, but in the present embodiment, grounding terminals 26 are disposed on an antenna part 10-side (i.e., an input terminal 16-side) end of second low-inductance part 21. To be more specific, the two grounding terminals 26 are disposed only on the antenna part 10-side end of second low-inductance part 21, and are not provided for second high-inductance part 22 and second tip part 23. Note that the end of second low-inductance part 21 means, for example, a region corresponding to a range of no greater than 10% of a length in the resonation direction of second low-inductance part 21 (the Y-axis direction in FIG. 5) from the antenna part 10-side end of second low-inductance part 21.

Second low-inductance part 21 is a part of grounding part 20 which is disposed at a location closest to antenna part 10. One end of second low-inductance part 21 is connected to grounding terminals 26, and another end is connected to second high-inductance part 22. The electrical length of second low-inductance part 21 is set so that the directionality of radio waves in the first frequency, radiated from antenna part 10, broadens along a plane perpendicular to the lengthwise direction of antenna part 10. A relationship between the electrical length of second low-inductance part 21 and the directionality of radio waves in the first frequency can be found through simulations or the like, for example. Additionally, a line width and pitch of meandering-shaped parts of two high-inductance elements 22*a* and 22*b* may be the same as a line width and pitch of meandering-shaped parts of first high-inductance part 12 of antenna part 10. This makes it possible to simplify the design of multiband antenna 1*a*.

Second low-inductance part 21 has a lower inductance than second high-inductance part 22. In the present embodiment, as illustrated in FIG. 5, second low-inductance part 21 is rectangular, but the shape of second low-inductance part 21 is not limited thereto. Second low-inductance part 21 may be designed with any shape as long as the inductance of second low-inductance part 21 is low enough so that second low-inductance part 21 does not act as a choke coil with respect to signals in the first frequency and the second frequency.

Second high-inductance part 22 is a part of grounding part 20 which is disposed between second low-inductance part 21 and second tip part 23, and has a meandering shape. Second high-inductance part 22 has a higher inductance than second low-inductance part 21. Second high-inductance part 22 acts as a choke coil with respect to signals in the first frequency band. In other words, the effective electrical length of grounding part 20 with respect to signals in the first frequency band induced by second low-inductance part 21 is the electrical length of second low-inductance part 21. Additionally, second high-inductance part 22 has an inductance low enough so that second high-inductance part 22 does not act as a choke coil with respect to signals in the second frequency band. Accordingly, second high-inductance part 22 does not inhibit signals in the second frequency band. As such, the effective electrical length of grounding part 20 with respect to signals in the second frequency band includes the electrical length of a channel including second high-inductance part 22 of grounding part 20.

Second high-inductance part 22 includes the two high-inductance elements 22*a* and 22*b*, which are connected to both ends of second low-inductance part 21 in the width direction thereof (the X-axis direction in FIG. 5). Opening 22*c* is formed between the two high-inductance elements 22*a* and 22*b*. In other words, a region in which a conductive member is not disposed is formed between the two high-inductance elements 22*a* and 22*b*. Note that it is acceptable for no opening to be provided in a region of board 140 corresponding to opening 22*c*. Each of the two high-inductance elements 22*a* and 22*b* has a meandering shape. The two high-inductance elements 22*a* and 22*b* have structures which are inverted horizontally with respect to each other. As such, the two high-inductance elements 22*a* and 22*b* have the same electrical length. Note that in the present embodiment, the electrical length of second high-inductance part 22 of multiband antenna 1*a* is defined by the electrical length of one of the two high-inductance elements 22*a* and 22*b*.

In second low-inductance part 21, current corresponding to transmitted and received radio waves flows mainly along edges of second low-inductance part 21, as indicated by the broken line arrows in FIG. 5. Thus by disposing the two high-inductance elements 22*a* and 22*b* at the ends of grounding part 20 in the width direction, the current indicated by the broken line arrows in FIG. 5 passes through one of high-inductance element 22*a* and high-inductance element 22*b*.

Second tip part 23 is a part of grounding part 20 located at an end furthest from antenna part 10 in the resonation direction. Although the shape of second tip part 23 is not particularly limited, second tip part 23 is rectangular in the present embodiment. Additionally, second tip part 23 connects the two high-inductance elements 22*a* and 22*b* of second high-inductance part 22. As such, in second tip part 23, a current component flowing to second tip part 23 from the two high-inductance elements 22*a* and 22*b* can be canceled out, and thus radio wave radiation broadening in the resonation direction, produced by that current component, can be suppressed.

Figure 6:
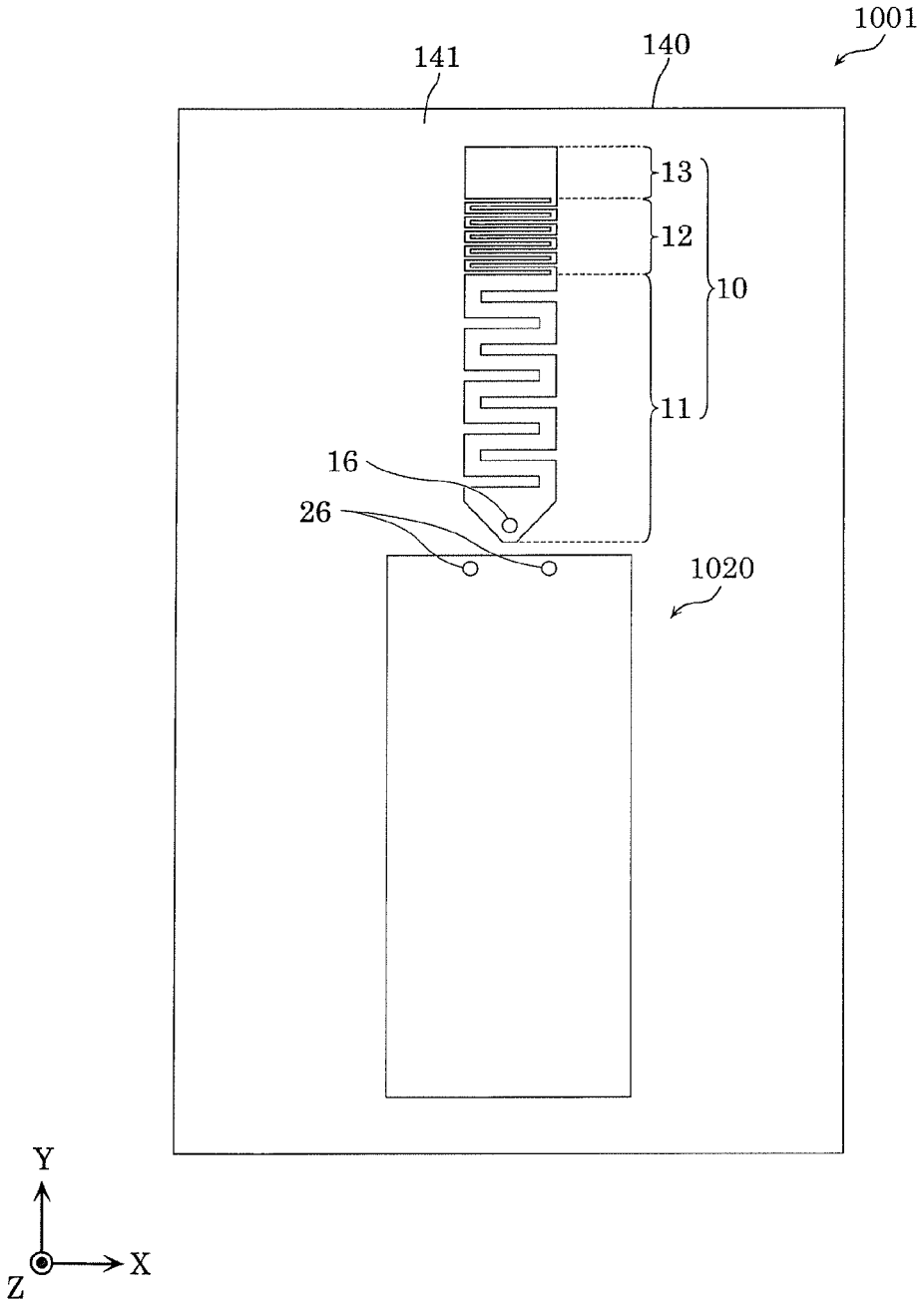
FIG. 6 is a plan view illustrating the configuration of a multiband antenna according to a comparative example.
Figure 7:
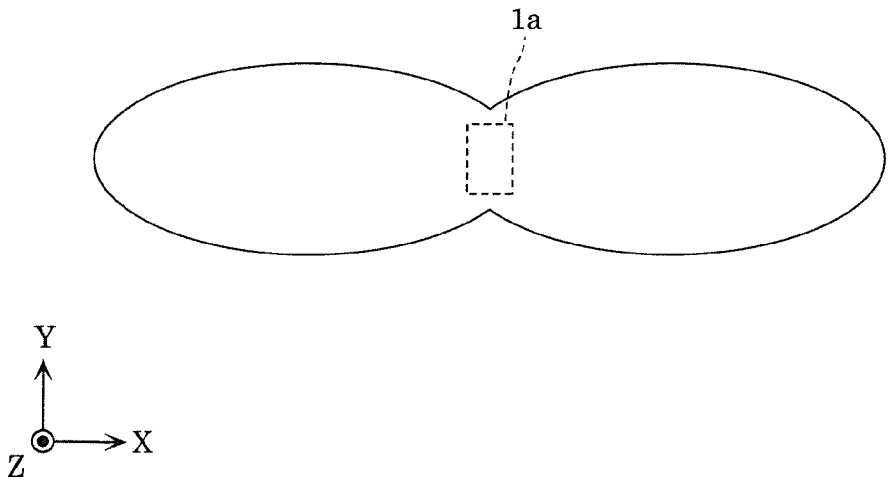
FIG. 7 is a diagram illustrating an overview of directionality for a first frequency of the multiband antenna according to Embodiment 2.
Figure 8:
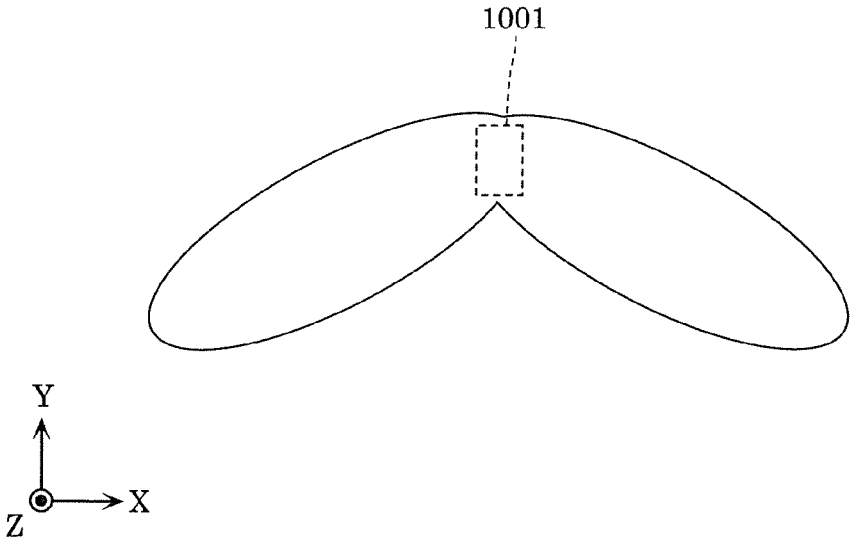
FIG. 8 is a diagram illustrating an overview of directionality for a first frequency of a multiband antenna according to a comparative example.

Here, actions and effects of multiband antenna 1*a* according to the present embodiment will be described with reference to FIGS. 6 to 8, in comparison with a multiband antenna according to a comparative example. FIG. 6 is a plan view illustrating the configuration of multiband antenna 1001 according to the comparative example. FIG. 6 is a plan view illustrating board 140 of multiband antenna 1001 according to the comparative example in plan view. FIGS. 7 and 8 are diagrams illustrating an overview of directionality for a first frequency of the multiband antennas according to the present embodiment and the comparative example.

Multiband antenna 1001 according to the comparative example, illustrated in FIG. 6, includes board 140, input terminal 16, grounding terminals 26, antenna part 10, and grounding part 1020, like multiband antenna 1*a* according to the present embodiment. Multiband antenna 1001 according to the comparative example is the same as multiband antenna 1*a* according to the present embodiment with the exception of the configuration of grounding part 1020. Grounding part 1020 according to the comparative example has the same electrical length as the overall electrical length of grounding part 20 according to the present embodiment. However, grounding part 1020 according to the comparative example has a flat plate shape. In other words, the entirety of grounding part 1020 according to the comparative example has the same configuration as second low-inductance part 21 of grounding part 20 according to the present embodiment.

With respect to signals in the second frequency, in multiband antenna 1*a* according to the present embodiment, the overall electrical length of grounding part 20 is set so that the directionality of radio waves in the second frequency, radiated from antenna part 10, broadens along a plane perpendicular to the lengthwise direction of antenna part 10. Because grounding part 1020 according to the comparative example has the same electrical length as grounding part 20 according to the present embodiment, the directionality of radio waves in the second frequency, radiated from antenna part 10, broadens along a plane perpendicular to the lengthwise direction of antenna part 10 in multiband antenna 1001 according to the comparative example as well.

However, with respect to signals in the first frequency, multiband antenna 1*a* according to the present embodiment includes second high-inductance part 22, which acts as a choke coil with respect to signals in the first frequency, and thus the effective electrical length of grounding part 20 with respect to signals in the first frequency band induced by second low-inductance part 21 is equivalent to the electrical length of second low-inductance part 21. Additionally, the electrical length of second low-inductance part 21 is set so that the directionality of radio waves in the first frequency, radiated from antenna part 10, broadens along a plane perpendicular to the lengthwise direction of antenna part 10. Thus as illustrated in FIG. 7, the directionality of radio waves in the first frequency broadens along a plane perpendicular to the lengthwise direction of antenna part 10.

As opposed to this, multiband antenna 1001 according to the comparative example does not include second high-inductance part 22, and thus the electrical length with respect to signals in the first frequency is equal to the overall electrical length of grounding part 1020, as is the case with the electrical length with respect to the second frequency. As illustrated in FIG. 8, in multiband antenna 1001 having such a configuration, the directionality of radio waves in the first frequency broadens in a direction tilted toward grounding part 20 (i.e., the downward diagonal direction in FIG. 8), relative to a plane perpendicular to the lengthwise direction of antenna part 10. Although FIG. 8 illustrates only the directionality in a plane parallel to an XY plane, the directionality of multiband antenna 1001 is the same as the directionality illustrated in FIG. 8 in all planes passing through input terminal 16 of multiband antenna 1001 and parallel to the Y axis. This is thought to be because in multiband antenna 1001 according to the comparative example, the effective electrical length of grounding part 1020 with respect to signals in the first frequency is longer than in multiband antenna 1*a* according to the present embodiment, and thus an electrical field component produced by current flowing to the tip end of grounding part 1020 is stronger than an electrical length component produced by antenna part 10.

As described above, in multiband antenna 1*a* according to the present embodiment, grounding part 20 includes second high-inductance part 22, which has a meandering shape, and thus the effective electrical length of grounding part 20 with respect to the first frequency can be made shorter than the effective electrical length with respect to signals in the second frequency. The effective electrical length of grounding part 20 can therefore be set appropriately with respect to both signals in the first frequency and the second frequency, which makes it possible to achieve directionality perpendicular to the resonation direction in frequency bands including those frequencies.

This multiband antenna 1*a* is particularly useful when used in array antenna 101 according to the present embodiment, for example. In other words, multiband antennas 1*a*, 1*b*, and 1*c* have directionality which is perpendicular to the resonation direction, and thus when array antenna 101 is configured by disposing multiband antennas 1*a*, 1*b*, and 1*c* in a direction perpendicular to the resonation direction as in the present embodiment, the reciprocal effects of radio waves radiated by the multiband antennas can be increased.

2-1-2. Ground Electrode 190

Ground electrode 190 is an electrode which is grounded. Ground electrode 190 is disposed on main surface 141 of board 140. In the present embodiment, ground electrode 190 is disposed in a position adjacent to grounding part 20 of each multiband antenna in array antenna 101. Ground electrode 190 also acts as shield wiring for each line disposed on the main surface of board 140 on the opposite side from main surface 141. Ground electrode 190 is, for example, a conductive member patterned on main surface 141 of board 140, and is formed, for example, from a metal film such as copper film. Ground electrode 190 is connected, by terminals 196*a* to 196*c*, 197, 198, and 199, to each conductive member disposed on the main surface of board 140 on the side opposite from main surface 141, through via interconnects passing through board 140.

2-1-3. Three-Way Divider

Figure 9:
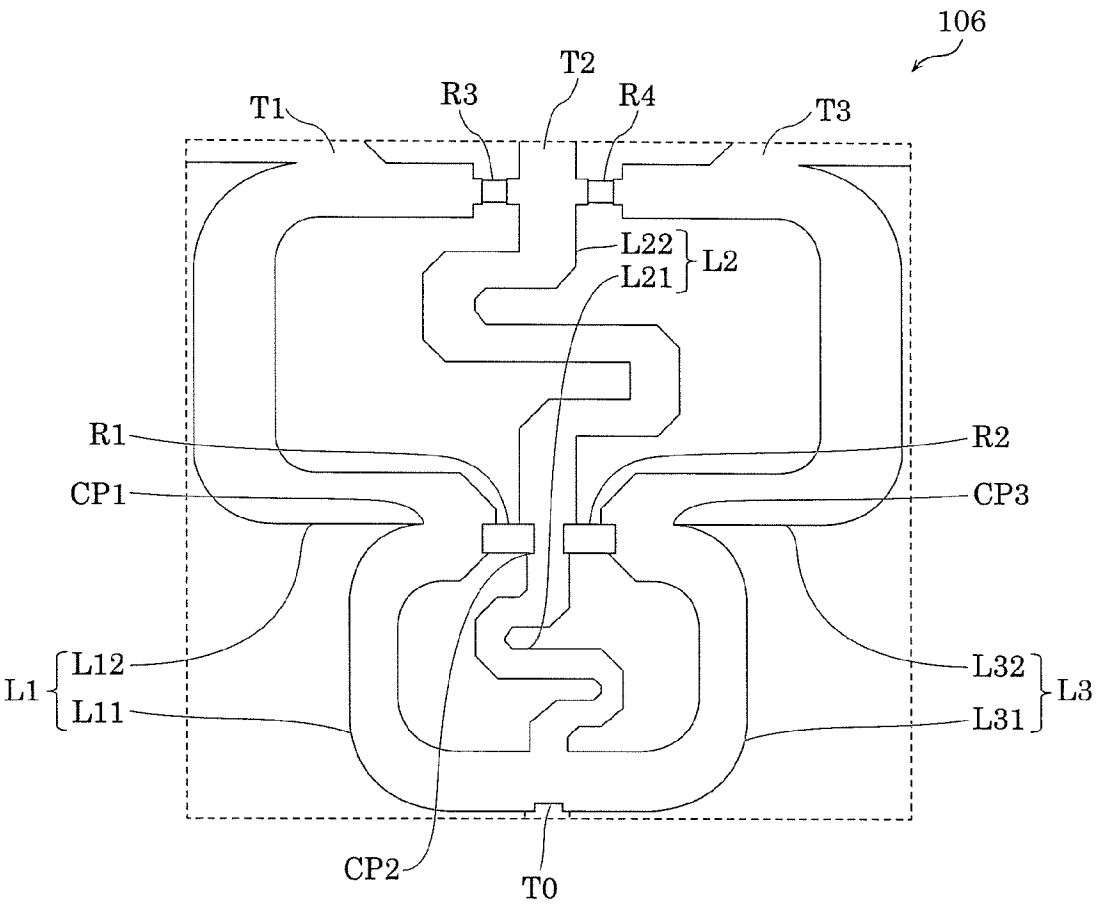
FIG. 9 is a plan view illustrating the configuration of a three-way divider according to Embodiment 2.

Three-way divider 106 is a divider which divides signals in the first frequency band and the second frequency band three ways. Three-way divider 106 according to the present embodiment will be described below with reference to FIG. 9. FIG. 9 is a plan view illustrating the configuration of three-way divider 106 according to the present embodiment. FIG. 9 is an enlargement of the part of FIG. 4 within the broken line box.

As illustrated in FIG. 9, three-way divider 106 includes input terminal T0, first output terminal T1, second output terminal T2, third output terminal T3, first transmission line L1, second transmission line L2, third transmission line L3, first resistor R1, second resistor R2, third resistor R3, and fourth resistor R4, like three-way divider 6 according to Embodiment 1.

Three-way divider 106 according to the present embodiment can, like three-way divider 6 according to Embodiment 1, be made smaller than a Wilkinson-type divider, and thus antenna module 100 can be made smaller as well.

Additionally, as illustrated in FIG. 9, the width of second input-side line L21 is narrower than the widths of first input-side line L11 and third input-side line L31. By reducing the width of second input-side line L21 in this manner, second input-side line L21 can be bent, which makes it easy to fit second input-side line L21 into a region interposed between first input-side line L11 and third input-side line L31 while maintaining the electrical length of second input-side line L21.

Additionally, the width of second output-side line L22 is narrower than the widths of first output-side line L12 and third output-side line L32. By reducing the width of second output-side line L22 in this manner, second output-side line L22 can be bent, which makes it easy to fit second output-side line L22 into a region interposed between first output-side line L12 and third output-side line L32 while maintaining the electrical length of second output-side line L22.

2-1-4. Connector

Connector Cn is a connecting member for inputting signals to antenna module 100 from the exterior. Although the configuration of connector Cn is not particularly limited, in the present embodiment, connector Cn is a coaxial connector. A signal interconnect of connector Cn is connected to input terminal T0 of three-way divider 106. Accordingly, signals can be input to three-way divider 106 from the exterior via connector Cn. Connector Cn has connector ground Cg which is grounded. Shield wiring of connector Cn is connected to connector ground Cg. Connector ground Cg is connected to terminal 198 of ground electrode 190 through a via interconnect passing through board 140.

2-1-5. Lines 61 to 63

Line 61 is a conductive member which connects line 71 to first output terminal T1 of three-way divider 106. The electrical length of line 61 is set on the basis of a phase difference between divided signals distributed to lines 71 to 73 and the electrical lengths of lines 62 and 63. Note that line 61 is connected to phase shifter 80, and a phase delay amount in line 61 changes depending on a state of phase shifter 80.

Line 62 is a conductive member which connects line 72 to second output terminal T2 of three-way divider 106. The electrical length of line 62 is set on the basis of a phase difference between divided signals distributed to lines 71 to 73 and the electrical lengths of lines 61 and 63.

Line 63 is a conductive member which connects line 73 to third output terminal T3 of three-way divider 106. The electrical length of line 63 is set on the basis of a phase difference between divided signals distributed to lines 71 to 73 and the electrical lengths of lines 61 and 62.

2-1-6. Phase Shifter

Phase shifter 80 is a device which is connected to line 61 and which changes a phase delay amount of the divided signal in line 61. Phase shifter 80 is a loaded line-type phase shifter. Phase shifter 80 includes lines 81 and 82, capacitors 83 and 84, PIN diodes 86 and 87, and ground electrode 85.

Line 81 is a line coupled to line 61 by capacitor 83. One end of line 81 is connected to capacitor 83, and another end is connected to PIN diode 86.

Line 82 is a line coupled to line 61 by capacitor 84. Line 82 is coupled to line 61 at a position different from the position at which line 81 is coupled. One end of line 82 is connected to capacitor 84, and another end is connected to PIN diode 87.

Capacitors 83 and 84 are elements for coupling line 61 to lines 81 and 82, respectively. In other words, phase shifter 80 and line 61 are coupled by capacitors 83 and 84. By coupling lines 81 and 82 to line 61 via capacitors 83 and 84, high-frequency signals can be exchanged between lines 81 and 82 and line 61 while suppressing the flow of DC current between lines 81 and 82 and line 61.

Ground electrode 85 is an electrode which is grounded. In the present embodiment, ground electrode 85 is connected to terminal 197 of ground electrode 190 through a via interconnect passing through board 140.

PIN diodes 86 and 87 are switches which switch a connection state between lines 81 and 82 and ground electrode 85 to an open state or a closed state. PIN diodes 86 and 87 are controlled by control signals input to control terminal Ts. In phase shifter 80, the phase delay amount of the divided signal in line 61 is switched by setting the states of both PIN diodes 86 and 87 to the open state or the closed state.

2-1-7. Control Terminal

Control terminal Ts is a terminal into which the control signals for controlling the states of PIN diodes 86 and 87 of phase shifter 80 are input. Control terminal Ts includes a ground terminal, and the ground terminal is connected to terminal 191 on board 140, and to terminal 199 of ground electrode 190 through a via interconnect passing through board 140.

2-1-8. Lines 71 to 73

Each of lines 71, 72, and 73 is a long conductive member into which a divided signal obtained from three-way divider 106 is input and which extends in the Y-axis direction in FIG. 4 (i.e., the resonation direction of each multiband antenna).

In the present embodiment, one end of line 71 is connected to line 61. Terminal 74 is provided at another end of line 71. Terminal 74 is connected to input terminal 16 of multiband antenna 1*a* through a via interconnect passing through board 140. Accordingly, the divided signal from first output terminal T1 of three-way divider 106 is input to line 71 via line 61, and line 71 outputs the divided signal to multiband antenna 1*a*.

One end of line 72 is connected to line 62. Terminal 76 is provided at another end of line 72. Terminal 76 is connected to input terminal 16 of multiband antenna 1*b* through a via interconnect passing through board 140. Accordingly, the divided signal from second output terminal T2 of three-way divider 106 is input to line 72 via line 62, and line 72 outputs the divided signal to multiband antenna 1*b*.

One end of line 73 is connected to line 63. Terminal 78 is provided at another end of line 73. Terminal 78 is connected to input terminal 16 of multiband antenna 1*c* through a via interconnect passing through board 140. Accordingly, the divided signal from third output terminal T3 of three-way divider 106 is input to line 73 via line 63, and line 73 outputs the divided signal to multiband antenna 1*c*.

2-1-9. Ground Lines 71*g* to 73*g*

Two ground lines 71*g* are long conductive members which are disposed along line 71 and which extend in the Y-axis direction in FIG. 4. The two ground lines 71*g* are arranged in the X-axis direction in FIG. 4, and line 71 is disposed between the two ground lines 71*g*. The two ground lines 71*g* and line 71 are disposed with gaps therebetween. Terminal 75*g* is disposed at one end, and terminal 74*g* is disposed at another end, of each of the two ground lines 71*g*. Terminals 75*g* are connected to terminals 196*a* of ground electrode 190 through via interconnects passing through board 140. Terminals 74*g* are connected to grounding terminals 26 of grounding part 20 of multiband antenna 1*a* through via interconnects passing through board 140.

Two ground lines 72*g* are long conductive members which are disposed along line 72 and which extend in the Y-axis direction in FIG. 4. The two ground lines 72*g* are arranged in the X-axis direction in FIG. 4, and line 72 is disposed between the two ground lines 72*g*. The two ground lines 72*g* and line 72 are disposed with gaps therebetween. Terminal 77*g* is disposed at one end, and terminal 76*g* is disposed at another end, of each of the two ground lines 72*g*. Terminals 77*g* are connected to terminals 196*b* of ground electrode 190 through via interconnects passing through board 140. Terminals 76*g* are connected to grounding terminals 26 of grounding part 20 of multiband antenna 1*b* through via interconnects passing through board 140.

Two ground lines 73*g* are long conductive members which are disposed along line 73 and which extend in the Y-axis direction in FIG. 4. The two ground lines 73*g* are arranged in the X-axis direction in FIG. 4, and line 73 is disposed between the two ground lines 73*g*. The two ground lines 73*g* and line 73 are disposed with gaps therebetween. Terminal 79*g* is disposed at one end, and terminal 78*g* is disposed at another end, of each of the two ground lines 73*g*. Terminals 79*g* are connected to terminals 196*c* of ground electrode 190 through via interconnects passing through board 140. Terminals 78*g* are connected to grounding terminals 26 of grounding part 20 of multiband antenna 1*c* through via interconnects passing through board 140.

The transmission lines, lines 61, 62, 63, 71 to 73, 81, and 82, and grounding interconnects 71*g*, 72*g*, and 73*g* of three-way divider 106 according to the present embodiment are, for example, conductive members patterned on the main surface of board 140 on the side opposite from main surface 141, and are formed, for example, from a metal film such as copper film.

Lines 71, 72, and 73 are formed as coplanar lines along with grounding interconnects 71*g*, 72*g*, and 73*g*, respectively.

The transmission lines and lines 61, 62, and 63 of three-way divider 106 according to the present embodiment, and lines 81 and 82 of phase shifter 80, are disposed in positions opposite ground electrode 190 with board 140 interposed therebetween. As such, the lines and ground electrode 190 form microstrip lines.

Line 71 and ground lines 71*g* illustrated in FIG. 4 are disposed in positions opposite grounding part 20 of multiband antenna 1*a* illustrated in FIG. 3. The width (dimension in the X-axis direction) of grounding part 20 is greater than a distance, in the X-axis direction, between outer edges of parts of the two ground lines 71*g* disposed along line 71 (i.e., in the example illustrated in FIG. 4, the parts of ground lines 71*g* excluding the periphery of terminals 75*g*). In other words, grounding part 20 extends further outward, in the X-axis direction, than the two ground lines 71*g*. In the present embodiment, the width of grounding part 20 is 7 mm, and the distance, in the X-axis direction, between outer edges of parts of the two ground lines 71*g* disposed along line 71 is 3 mm. Accordingly, a situation where radio waves produced by current flowing in the ends, in the X-axis direction, of grounding part 20 (see the broken line arrows in FIG. 5) are blocked by the two ground lines 71*g* can be suppressed. A worsening of the directionality in the Z-axis direction of multiband antenna 1*a* can therefore be suppressed. Like the width of grounding part 20 of multiband antenna 1*a*, the widths of grounding parts 20 of multiband antennas 1*b* and 1*c* are greater than the distances, in the X-axis direction, between outer edges of parts of the two opposing ground lines disposed along lines 72 and 73.

2-2. Actions and Effects

Figure 10:
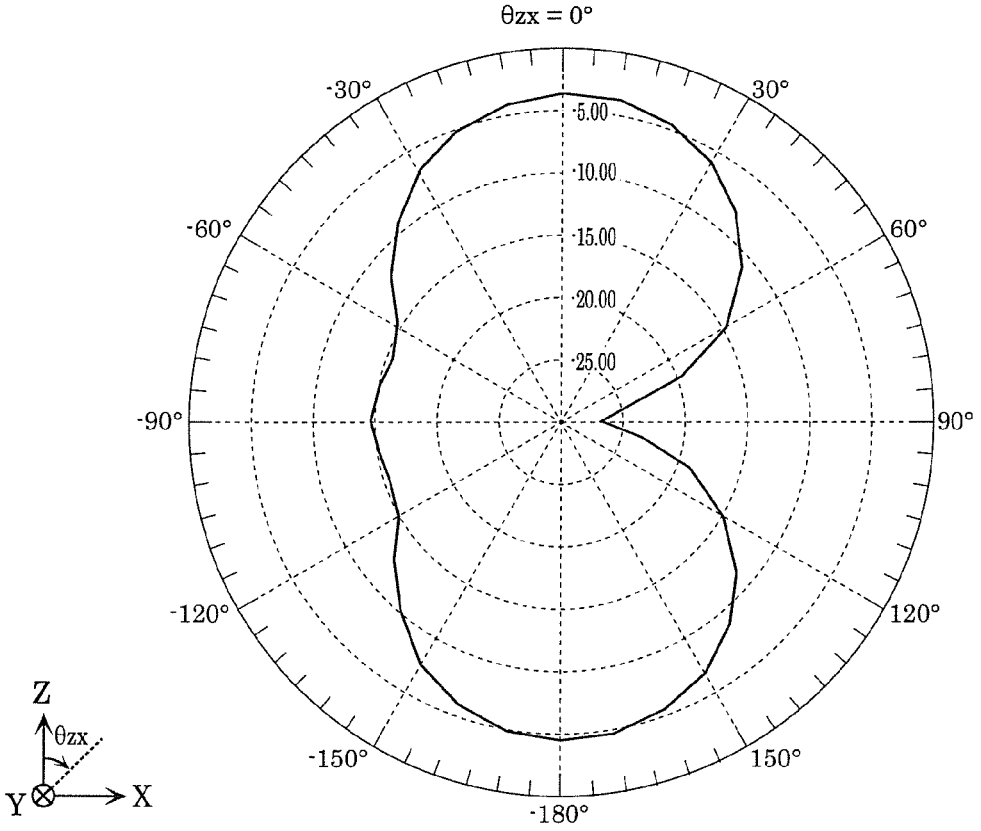
FIG. 10 is a graph illustrating directionality of an array antenna according to Embodiment 2.

Actions and effects of antenna module 100 according to the present embodiment will be described next. As described above, in antenna module 100 according to the present embodiment, appropriately setting the electrical lengths of lines 61, 62, and 63 makes it possible to adjust the phases of the signals input to the multiband antennas constituting array antenna 101. This makes it possible to adjust the directionality of array antenna 101. For example, when an antenna which transmits and receives signals in frequency band near the frequency band handled by antenna module 100 is present near antenna module 100, lowering the directionality of array antenna 101 of antenna module 100 in a direction facing from array antenna 101 toward that other antenna makes it possible to reduce radio wave interference between antenna module 100 and the other antenna. Such directionality of array antenna 101 will be described with reference to FIG. 10. FIG. 10 is a graph illustrating directionality of array antenna 101 according to the present embodiment. Note that FIG. 10 illustrates the directionality when both PIN diodes 86 and 87 in phase shifter 80 of antenna module 100 are off. Note also that angle θzx in FIG. 10 indicates an angle of inclination from the Z-axis direction toward the X-axis direction in each drawing.

In the example illustrated in FIG. 10, directionality is reduced with respect to the positive side of the X-axis direction. Accordingly, when another antenna is present on the positive side, in the X-axis direction, of array antenna 101 having such directionality, interference between array antenna 101 and the other antenna can be reduced.

Additionally, in antenna module 100 according to the present embodiment, the phase of the signal input to multiband antenna 1*a* can be switched by phase shifter 80. The phase of the signal input to multiband antenna 1*a* can be changed by approximately 50° by phase shifter 80 according to the present embodiment, when both PIN diodes 86 and 87 are off, and when the PIN diodes are on. Effects provided by phase shifter 80 will be described here with reference to FIG. 11.

Figure 11:
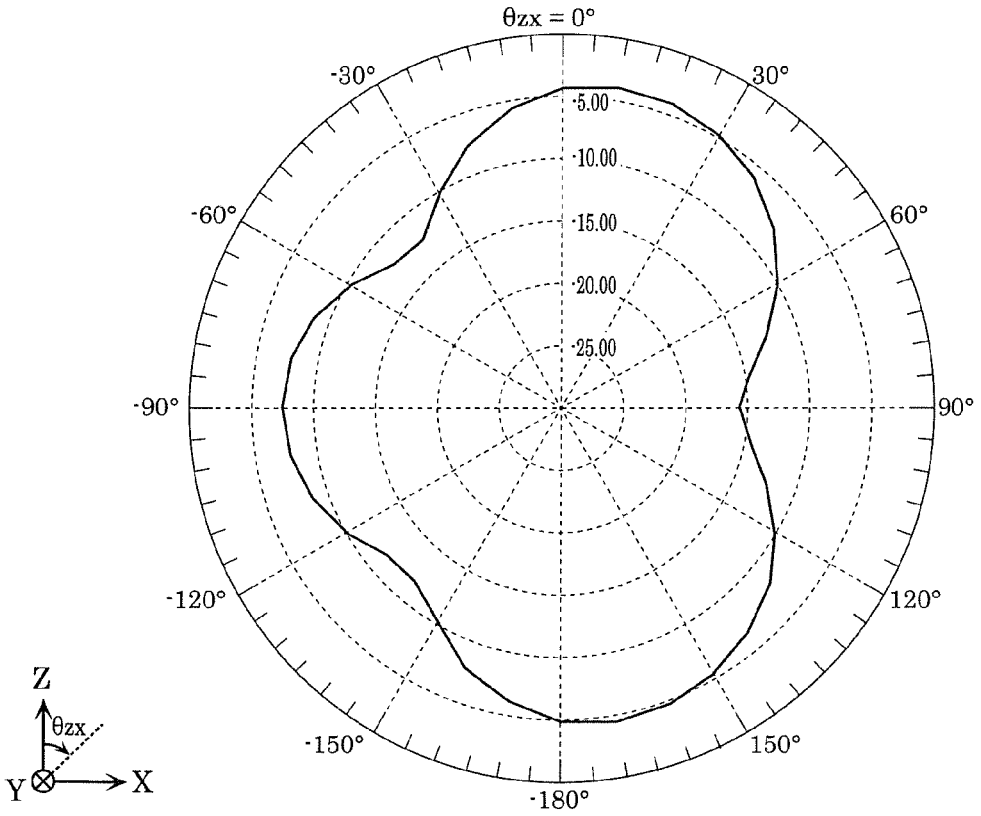
FIG. 11 is a graph illustrating directionality of the array antenna according to Embodiment 2 when the state of a phase shifter has been changed.

FIG. 11 is a graph illustrating directionality of array antenna 101 according to the present embodiment when the state of phase shifter 80 has been changed. FIG. 11 illustrates the directionality when both PIN diodes 86 and 87 in phase shifter 80 are turned on. Note also that angle θzx in FIG. 11 indicates an angle of inclination from the Z-axis direction toward the X-axis direction in each drawing. As can be seen from the directionalities illustrated in FIGS. 10 and 11, the directionality of array antenna 101 can be changed greatly by phase shifter 80. This effect of phase shifter 80 is useful when there is a shifting radio wave environment around antenna module 100. For example, when the positions of antenna module 100 and the other antenna have been changed, the relative positions of antenna module 100 and the other antenna can change as well. Additionally, if antenna module 100 and the other antenna are moved, even if the relative positions of antenna module 100 and the other antenna have not changed, the relative positions of surrounding structures and antenna module 100 can change. In this case, radio waves radiated from the other antenna are reflected by the surrounding structures, and thus in array antenna 101 of antenna module 100, interference from those reflected waves can become problematic. By changing the directionality of array antenna 101 using phase shifter 80 in situations where the radio wave environment changes in this manner, interference with other radio waves can be suppressed.

2-3. Application Example

Figure 12:
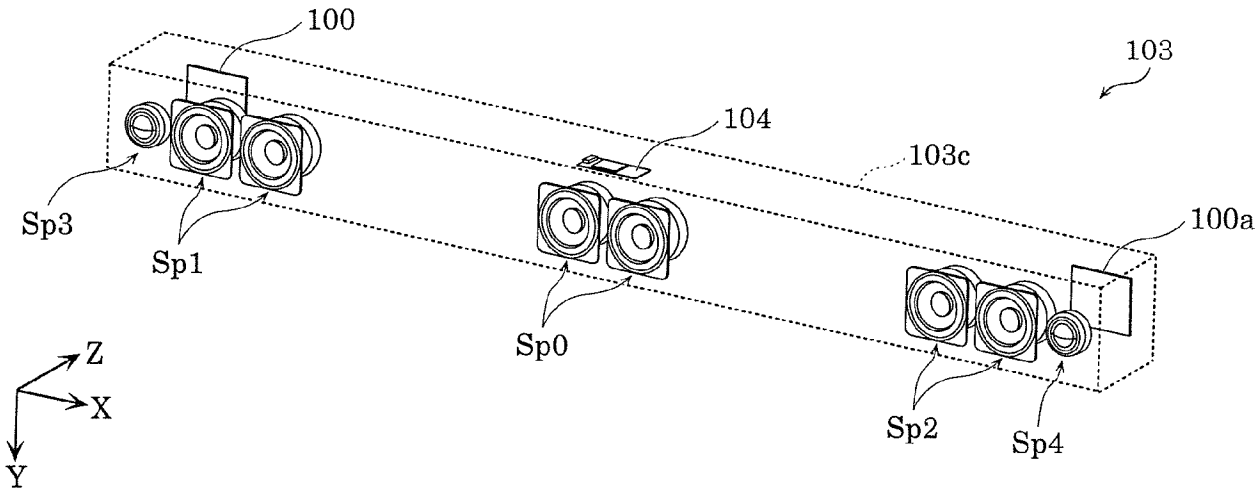
FIG. 12 is a perspective view illustrating the configuration of an audio device including the antenna module according to Embodiment 2.

An application example of antenna module 100 according to the present embodiment will be described next with reference to FIG. 12. FIG. 12 is a perspective view illustrating the configuration of audio device 103 including antenna module 100 according to the present embodiment.

Audio device 103 illustrated in FIG. 12 mainly includes housing 103*c*, antenna modules 100, 100*a*, and 104, and speakers Sp0 to Sp4. Note that in FIG. 12, only the contours of housing 103*c* are indicated, using dotted lines, in order to show the locations of the respective constituent elements.

Antenna module 100*a* is a module which communicates wirelessly on the basis of the same wireless LAN standard as antenna module 100, and transmits and receives signals in the 5 GHz and 2.4 GHz bands. Antenna module 100*a* is the same as antenna module 100, with the exception of the structures and locations of the constituent elements being flipped horizontally with respect to antenna module 100. As such, the directionality of the array antenna included in antenna module 100*a* is flipped horizontally with respect to the directionality of array antenna 101 in antenna module 100 (i.e., the graphs illustrated in FIGS. 10 and 11 are inverted horizontally).

Antenna module 104 is a module which communicates wirelessly with another device. In the present embodiment, antenna module 104 transmits signals in the 2.4 GHz band to another audio device, on the basis of a standard different from the wireless LAN standard. Here, the other audio device is a subwoofer or the like, for example.

As described above, audio device 103 includes the three antenna modules 100, 100*a*, and 104, which handle signals in the 2.4 GHz band, and thus radio wave interference can arise among these modules. However, array antenna 101 of antenna module 100 according to the present embodiment has low directionality on the positive side of the X-axis direction, as illustrated in FIG. 10, and thus radio wave interference with other modules can be reduced.

Additionally, antenna module 100*a* has a structure which is flipped horizontally with respect to antenna module 100, and thus the array antenna in antenna module 100*a* has low directionality on the negative side of the X-axis direction. Radio wave interference with another antenna module disposed on the negative side, in the X-axis direction, of antenna module 100*a* can therefore be reduced.

Depending on the positional relationship between audio device 103 and surrounding structures, radio waves radiated from antenna module 104 may be reflected by the structures and reach antenna modules 100 and 100*a*. In such a state, if interference from the reflected radio waves is a problem in antenna modules 100 and 100*a*, interference with those reflected radio waves can be reduced by changing the settings of the phase shifters in antenna modules 100 and 100*a* to change the directionality of each array antenna.

Variations, Etc.

A three-way divider according to the present disclosure has been described based on embodiments. However, the present disclosure is not limited to the foregoing embodiments. Various conceivable variations made on the embodiments by one skilled in the art also fall within the scope of the present disclosure as long as those variations do not depart from the essential spirit of the present disclosure.

For example, Embodiment 2 described an example in which antenna module 100 is used in audio device 103, but antenna module 100 can be used in another device instead. For example, antenna module 100 may be used in a television receiver or the like.

Additionally, although a dual-band antenna which transmits and receives signals in two frequency bands was described as an example of multiband antenna 1*a*, the multiband antenna according to the present disclosure may transmit and receive in three or more frequency bands. For example, a multiband antenna can be implemented which, in addition to the first frequency band and the second frequency band, transmits and receives in a third frequency band including a third frequency which is lower than the first frequency and higher than the second frequency. For example, in multiband antenna 1*a* according to Embodiment 2, by inserting a first mid-inductance part between first low-inductance part 11 and first high-inductance part 12, and inserting a second mid-inductance part between second low-inductance part 21 and second high-inductance part 22, a multiband antenna which can transmit and receive signals in three frequency bands, namely the first frequency band to the third frequency band, can be realized.

Here, the first mid-inductance part has a higher inductance than first low-inductance part 11 and a lower inductance than first high-inductance part 12. Likewise, the second mid-inductance part has a higher inductance than second low-inductance part 21 and a lower inductance than second high-inductance part 22. First low-inductance part 11 and second low-inductance part 21 do not act as choke coils with respect to signals in the third frequency. First mid-inductance part and second mid-inductance part act as choke coils with respect to signals in the first frequency, but do not act as choke coils with respect to signals in the second frequency and the third frequency. First high-inductance part 12 and second high-inductance part 22 act as choke coils with respect to signals in the third frequency. The sum of the electrical lengths of first low-inductance part 11 and the first mid-inductance part is ¼ the wavelength of the third frequency.

Additionally, embodiments achieved by combining constituent elements and functions from the embodiments as desired within a scope which does not depart from the spirit of the present disclosure, and the like are also included in the present disclosure.

INDUSTRIAL APPLICABILITY

The three-way divider according to the present disclosure can be used as a three-way divider for an antenna module used in an audio device or the like, for example.

The invention claimed is:

1. A three-way divider that divides a signal three ways, the three-way divider comprising:

an input terminal into which the signal is input;

a first output terminal, a second output terminal, and a third output terminal, each of which outputs a corresponding one of three divided signals obtained by the signal having been divided three ways;

a first transmission line, a second transmission line, and a third transmission line that connect the input terminal to the first output terminal, the second output terminal, and the third output terminal, respectively; and a first resistor, a second resistor, a third resistor, and a fourth resistor, wherein the first transmission line includes, in order from a side on which the input terminal is located, a first input-side line and a first output-side line connected in series at a first connection point, the second transmission line includes, in order from the side on which the input terminal is located, a second input-side line and a second output-side line connected in series at a second connection point, the third transmission line includes, in order from the side on which the input terminal is located, a third input-side line and a third output-side line connected in series at a third connection point, each of the first input-side line, the second input-side line, and the third input-side line has an electrical length that is ¼ a wavelength of a first frequency, each of the first transmission line, the second transmission line, and the third transmission line has an electrical length that is ¼ a wavelength of a second frequency that is lower than the first frequency, and the first connection point and the second connection point are connected via the first resistor, the third connection point and the second connection point are connected via the second resistor, the first output terminal and the second output terminal are connected via the third resistor, and the third output terminal and the second output terminal are connected via the fourth resistor.

2. The three-way divider according to claim 1, wherein the first resistor, the second resistor, the third resistor, and the fourth resistor have a same resistance value.

3. The three-way divider according to claim 1, wherein each of the first resistor, the second resistor, the third resistor, and the fourth resistor has a resistance value of at least 50Ω and at most 100Ω.

4. The three-way divider according to claim 1, wherein a width of the second input-side line is narrower than a width of the first input-side line and a width of the third input-side line.

5. The three-way divider according to claim 1, wherein a width of the second output-side line is narrower than widths of the first output-side line and the third output-side line.

* * * * *